US012383009B2

(12) United States Patent
Sato et al.

(10) Patent No.: US 12,383,009 B2
(45) Date of Patent: Aug. 12, 2025

(54) FIBER FOR ARTIFICIAL HAIR, AND WIG

(71) Applicant: Aderans Company Limited, Tokyo (JP)

(72) Inventors: Shunsuke Sato, Tokyo (JP); Shiho Matsumoto, Tokyo (JP); Fumitaka Sugawara, Tokyo (JP)

(73) Assignee: ADERANS COMPANY LIMITED, Tokyo (JP)

( * ) Notice: Subject to any disclaimer, the term of this patent is extended or adjusted under 35 U.S.C. 154(b) by 215 days.

(21) Appl. No.: 18/267,529

(22) PCT Filed: Feb. 28, 2022

(86) PCT No.: PCT/JP2022/008340
§ 371 (c)(1),
(2) Date: Jun. 15, 2023

(87) PCT Pub. No.: WO2022/186149
PCT Pub. Date: Sep. 9, 2022

(65) Prior Publication Data

US 2024/0057704 A1 Feb. 22, 2024

(30) Foreign Application Priority Data

Mar. 1, 2021 (JP) ..... 2021-032017
Nov. 11, 2021 (JP) ..... 2021-184271

(51) Int. Cl.
*D01F 8/12* (2006.01)
*A41G 3/00* (2006.01)

(52) U.S. Cl.
CPC ..... *A41G 3/0083* (2013.01); *D01F 8/12* (2013.01); *D10B 2331/02* (2013.01);
(Continued)

(58) Field of Classification Search
CPC ..... D01F 8/12
See application file for complete search history.

(56) References Cited

U.S. PATENT DOCUMENTS 4,425,393 A * 1/1984 Benedyk ..... D01F 6/02 428/95
5,364,582 A * 11/1994 Lilly ..... D01F 1/09 264/211

(Continued)

FOREIGN PATENT DOCUMENTS

JP 47-37649 9/1972
JP 61-258019 11/1986

(Continued)

OTHER PUBLICATIONS

International Preliminary Report on Patentability issued Aug. 29, 2023 in corresponding International (PCT) Patent Application No. PCT/JP2022/008340.

(Continued)

*Primary Examiner* — Andrew T Piziali
(74) *Attorney, Agent, or Firm* — WENDEROTH, LIND & PONACK, L.L.P.

(57) ABSTRACT

A problem to be solved of the invention is to provide a fiber for artificial hair comprising polyamide, which has a glossy feeling with suppressed luster similar to natural hair, is excellent in persistent antistatic properties, and also excellent in heat-setting properties. The means for solving the problem is a fiber for artificial hair comprising a thermoplastic polyamide and a polymeric antistatic agent having compatibility with the thermoplastic polyamide, wherein the polymeric antistatic agent has a melting point equal to or lower than the melting point of the thermoplastic polyamide.

18 Claims, 3 Drawing Sheets

(52) U.S. Cl.
CPC .... *D10B 2331/04* (2013.01); *D10B 2401/041* (2013.01); *D10B 2503/08* (2013.01)

(56) References Cited

U.S. PATENT DOCUMENTS

| | | | | |
|---|---|---|---|---|
| 2004/0087734 | A1 | 5/2004 | Bianchi et al. | |
| 2020/0077725 | A1* | 3/2020 | Akahane | D01F 1/10 |

FOREIGN PATENT DOCUMENTS

| | | |
|---|---|---|
| JP | 1-282309 | 11/1989 |
| JP | 2004-3089 | 1/2004 |
| JP | 2004-502819 | 1/2004 |
| JP | 2010-202714 | 9/2010 |
| JP | 2012-245084 | 12/2012 |
| JP | 2015-131960 | 7/2015 |
| JP | 2019-65433 | 4/2019 |
| JP | 2010-133043 | 6/2020 |
| WO | 2010/134561 | 11/2010 |

OTHER PUBLICATIONS

Extended European Search Report issued Mar. 14, 2025 in corresponding European Patent Application No. 22763205.6.
International Search Report (ISR) issued Apr. 26, 2022 in International (PCT) Application No. PCT/JP2022/008340.

* cited by examiner

FIBER FOR ARTIFICIAL HAIR, AND WIG

CROSS-REFERENCE TO RELATED APPLICATION

This application claims the benefit under Article 4 of the Paris Convention based on Japanese Patent Application No. 2021-32017 filed on Mar. 1, 2021 and No. 2021-184271 filed on Nov. 11, 2021 incorporated herein by reference in their entirely.

TECHNICAL FIELD

The present invention relates to a fiber for artificial hair used for wigs, hair for increasing the hair or hair substitutes, and in particular to a fiber for artificial hair comprising polyamide.

BACKGROUND ART

The fiber for artificial hair comprising polyamide is more flexible and supple than synthetic fiber such as polyester, and has a texture and feel more similar to natural hair. On the other hand, it is difficult to express a glossy feeling characteristic of natural hair expressed by concavoconvex of cuticles. In addition, a fiber for artificial hair generally has low moisture-retaining properties and generates static electricity during hairstyling, making it difficult to set a hairstyle.

Patent Document 1 discloses a fiber for artificial hair formed from a first thermoplastic resin that is a matrix, and a second thermoplastic resin which is incompatible with and has a different melting point from the first thermoplastic resin, the fiber having concavoconvex configuration on its surface, wherein convex portions of the fiber are formed from the first thermoplastic resin. The fiber for artificial hair in Patent Document 1 is capable of suppressing luster without damaging physical property values of the matrix such as strength, and while keeping a glossy feeling of natural hair.

Patent Document 2 discloses a fiber material for artificial hair obtained by mixing polyamide with an additive composed of polyalkylene ether phosphate compounds, making the mixture filamentary, and eluting the additive. Since the above additive has water retention and antistatic properties, the fiber material for artificial hair in Patent Document 2 exhibits water retention and antistatic properties. On the other hand, due to the elution of the additive, traces which had been occupied by the additive form recesses or sponge-like cavities, so that small voids are formed on the surface of the fiber material.

Patent Document 3 discloses a polyamide fiber for artificial hair formed from a nylon 4,6 polymer composition containing cuprous halide, and an alkaline metal halide or an alkaline earth metal halide as heat-resistant agents. Conductive substances such as conductive carbon black may be added to this polyamide fiber for artificial hair, which makes it possible to prevent deterioration in shape retention properties due to charging of static electricity and dirt due to adhesion of dust.

PRIOR ART DOCUMENT

Patent Document

[Patent Document 1] WO 2010/134561 A1
[Patent Document 2] JP S47(1972)-37649 B
[Patent Document 3] JP H1(1989)-282309 A

SUMMARY OF INVENTION

Problems to be Solved by the Invention

It is preferable in artificial hair that a predetermined curl is formed in advance at the production stage. By doing so, when user of the artificial hair sets a hairstyle, the set hairstyle is able to be kept for a long time. In addition, it is preferable that the artificial hair is not charged with static electricity. In such a case, user is able to easily perform the work to form the desired hairstyle (hereinafter sometimes referred to as "styling") using a brush and the like.

For example, the fiber for artificial hair containing polyamide disclosed in Patent Document 1 does not have sufficient antistatic properties and formability by heat treatment (hereinafter sometimes referred to as "heat-setting properties"), and there is still the problem that forming curls at the production stage and styling during use are difficult.

When the additive of Patent Document 2 is used, the small voids that would not normally exist in natural hair are formed on the surface of the fiber material, making it difficult to express a glossy feeling characteristic of natural hair. In addition, since the additive in Patent Document 2 migrates from the interior to surface of the fiber material, it drops off each time shampooing and wiping are performed, and has insufficient persistence in antistatic properties.

The conductive substance of Patent Document 3 is incompatible with polyamide and has a great effect on the physical properties of the fiber for artificial hair, such as flexibility and strength, making it difficult to reproduce the texture of natural hair when this is used.

The present invention solves the above problems, and an object thereof is to provide a fiber for artificial hair comprising polyamide, which has a glossy feeling with suppressed luster similar to natural hair, is excellent in persistent antistatic properties, and also excellent in heat-setting properties.

Means for Solving the Problem

The present invention provides a fiber for artificial hair comprising a thermoplastic polyamide and a polymeric antistatic agent having compatibility with the thermoplastic polyamide, wherein the polymeric antistatic agent has a melting point equal to or lower than the melting point of the thermoplastic polyamide.

In one embodiment, the polymeric antistatic agent has a melting point of 160 to 250° C.

In one embodiment, the polymeric antistatic agent has a melt flow rate at 215° C. of 10 to 40 g/10 min.

In one embodiment, the polymeric antistatic agent has a surface specific resistance value of $10^6$ to $10^{10}\Omega/\square$.

In one embodiment, the polymeric antistatic agent comprises a polyetheresteramide block copolymer.

In one embodiment, the polyetheresteramide block copolymer is a condensation product of polyamide having carboxyl groups at both ends and an aromatic ring-containing polyether diol.

In one embodiment, the polymeric antistatic agent is contained in an amount of 0.5 to 10% by weight.

In one embodiment, the fiber for artificial hair further comprises a thermoplastic polyester which is incompatible with and has a higher melting point than the thermoplastic polyamide.

In one embodiment, the fiber for artificial hair has a weight ratio of the thermoplastic polyamide to the thermoplastic polyester of 75/25 to 85/15.

In one embodiment, the fiber for artificial hair has concavoconvex configuration formed on its surface, and convex portions in the concavoconvex configuration comprises thermoplastic polyester particles.

In one embodiment, the fiber for artificial hair has a matrix comprising the thermoplastic polyamide and a domain comprising the thermoplastic polyester.

In one embodiment, the thermoplastic polyamide is at least one thermoplastic resin selected from the group consisting of a linear saturated aliphatic polyamide, an alternating copolymer of hexamethylenediamine and terephthalic acid, and an alternating copolymer of meta-xylenediamine and adipic acid.

In one embodiment, the thermoplastic polyester is at least one thermoplastic resin selected from the group consisting of polyethylene terephthalate and polybutylene terephthalate.

Also, the present invention provides a wig having a wig base and fibers for artificial hair according to any one of the above implanted in the wig.

Effect of the Invention

The fiber for artificial hair comprising polyamide according to the present invention has a glossy feeling with suppressed luster similar to natural hair, is excellent in antistatic properties, and also excellent in heat-setting properties. Therefore, the fiber for artificial hair of the present invention can be appropriately curled at the production stage, can be easily styled during use, and the styled hairstyle is kept for a long time.

DESCRIPTION OF EMBODIMENTS

<Fiber for Artificial Hair>

Figure 1:
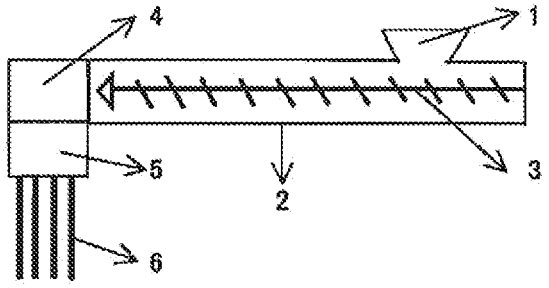
FIG. 1 is a schematic view of a common single-screw extruder used for the production of synthetic fibers used in the present invention.

The fiber for artificial hair of the present invention comprises a thermoplastic polyamide and a polymeric antistatic agent having compatibility with the thermoplastic polyamide. The thermoplastic polyamide is a member that constitutes the external form of an artificial hair fiber, i.e., a matrix. That gives the fiber for artificial hair a texture and feel similar to those of natural hair, resulting in excellent antistatic and heat-setting properties.

(Thermoplastic Polyamide)

The thermoplastic polyamide contained in the fiber for artificial hair of the present invention may be one that has been conventionally used as a raw material of a fiber for artificial hair. The thermoplastic polyamide includes linear saturated aliphatic polyamides, such as nylon 6, nylon 66, and nylon 610, or semi-aromatic polyamides, such as nylon 6T composed of an alternating copolymer of hexamethylenediamine and terephthalic acid, and MXD6 that is a polymer in which adipic acid and meta-xylenediamine are amide-bonded.

The thermoplastic polyamide preferably has a melting point of 170 to 270° C. If the melting point of the thermoplastic polyamide is less than 170° C., heat resistance as artificial hair becomes insufficient, and if it exceeds 270° C., an unmelted residue is mixed causing defects. The melting point of the thermoplastic polyamide is more preferably 200 to 250° C., and still more preferably 215 to 240° C.

The thermoplastic polyamide preferably has a melt flow rate of 10 to 80 g/10 min at 240° C. and 21.18 N. If the above melt flow rate of the thermoplastic polyamide is less than 10 g/10 min, insufficient kneading results in uneven color development, and if it exceeds 80 g/10 min, it causes molding defects due to draw resonance. The melt flow rate of the thermoplastic polyamide is more preferably 15 to 60 g/10 min, and still more preferably 20 to 40 g/10 min.

(Polymeric Antistatic Agent)

The polymeric antistatic agent contained in the fiber for artificial hair of the present invention may be one that has been conventionally used as an antistatic agent for synthetic resin materials. The polymeric antistatic agent has low humidity dependence and hardly migrates from the interior to surface of a fiber material. In other words, the polymeric antistatic agent is added to a polymer material to make it compatible therewith, and thereby, conductive circuits are formed inside the fiber material, and antistatic properties are imparted. As a result, the resulting fiber for artificial hair has a good appearance and feel, and the antistatic effect is excellent in persistence.

The polymeric antistatic agent preferably has a polyether structure from the viewpoint of achieving the above effect. Also, the polymeric antistatic agent more preferably has a polyethylene oxide structure.

The polymeric antistatic agent preferably has a melting point of 160 to 250° C. If the melting point of the polymeric antistatic agent is less than 160° C., the heat-setting properties of the resulting fiber for artificial hair are reduced. If it exceeds 250° C., the polymeric antistatic agent is hardly uniformly mixed in the fiber material, and the antistatic effect of the resulting fiber for artificial hair is liable to become insufficient, and poor appearance is liable to occur. The melting point of the polymeric antistatic agent is preferably 180 to 230° C., and more preferably 190 to 210° C.

The polymeric antistatic agent preferably has a melting point that is approximate to the melting point of the thermoplastic polyamide used as the matrix. The melting point of the polymeric antistatic agent is approximate to the melting point of the thermoplastic polyamide, which makes it easier to improve curl performance of the fiber for artificial hair. For the melting point of the polymeric antistatic agent, for example, the temperature difference from the melting point of the thermoplastic polyamide is within 30° C., preferably within 15° C., and more preferably within 10° C.

The polymeric antistatic agent preferably has a melting point equal to or lower than the melting point of the thermoplastic polyamide used as the matrix. If the melting point of the polymeric antistatic agent exceeds the melting point of the thermoplastic polyamide, the polymeric antistatic agent may be hardly uniformly mixed in the fiber material.

In a certain embodiment, the polymeric antistatic agent preferably has a melt flow rate of 10 to 40 g/10 min at 215° C. and 21.18 N. If the melt flow rate of the polymeric antistatic agent is less than 10 g/10 min, the polymeric antistatic agent is hardly uniformly mixed in the fiber material, the antistatic effect of the resulting fiber for artificial hair is liable to become insufficient, and poor appearance is liable to occur. If it exceeds 40 g/10 min, the polymeric antistatic agent easily migrates from the interior to surface in the fiber material, and the appearance, feel or persistence in the antistatic effect may deteriorate. The above melt flow rate of the polymeric antistatic agent is preferably 15 to 35 g/10 min, and more preferably 18 to 32 g/10 min.

In another embodiment, the polymeric antistatic agent preferably has a melt flow rate of 3 to 35 g/10 min at 190° C. and 21.18 N. If the melt flow rate of the polymeric antistatic agent is less than 3 g/10 min, the polymeric antistatic agent is hardly uniformly mixed in the fiber material, the antistatic effect of the resulting fiber for artificial hair is liable to become insufficient, and poor appearance is liable to occur. If it exceeds 35 g/10 min, the polymeric antistatic agent easily migrates from the interior to surface of the fiber material, and the appearance, feel, or persistence in the antistatic effect may deteriorate. The above melt flow rate of the polymeric antistatic agent is preferably 5 to 30 g/10 min, and more preferably 8 to 17 g/10 min.

The polymeric antistatic agent preferably has a melt flow rate greater than or equal to the melt flow rate of the thermoplastic polyamide used as the matrix. If the melt flow rate of the polymeric antistatic agent is less than the melt flow rate of the thermoplastic polyamide, the polymeric antistatic agent may be hardly uniformly mixed in the fiber material.

The polymeric antistatic agent preferably has a surface specific resistance value of $10^{10}\Omega/\square$ or less. If the surface specific resistance value of the polymeric antistatic agent exceeds $10^{10}\Omega/\square$, the antistatic effect is liable to be insufficient. The surface specific resistance value of the polymeric antistatic agent is preferably $5\times10^{9}\Omega/\square$ or less, and more preferably $10^{6}$ to $10^{9}\Omega/\square$. The surface specific resistance value of the polymeric antistatic agent may be measured using a super insulation meter after the polymeric antistatic agent is formed independently and moistened at 23° C. and 50 RH for 4 hours.

The polymeric antistatic agent has a thermal decomposition initiation temperature of 200° C. or higher. If the thermal decomposition initiation temperature of the polymeric antistatic agent is lower than 200° C., the polymeric antistatic agent is easily decomposed and degraded in the process of spinning the fiber material. The thermal decomposition initiation temperature of the polymeric antistatic agent is preferably 230° C. or higher, and more preferably 250 to 300° C. The thermal decomposition initiation temperature of the polymeric antistatic agent may be measured in air using a thermogravimetric-differential thermal analyzer (TG-DTA).

Commercially available polymeric antistatic agents may be used. Examples of commercially available polymeric antistatic agents include "PELESTAT 6200" (trade name) manufactured by SANYO CHEMICAL INDUSTRIES, LTD., "PELESTAT 6500" (trade name), "PELESTATNC 6321" (trade name) manufactured by the same, "PELESTAT NC 7530" (trade name) manufactured by the same, "PELECTRON AS" (trade name) manufactured by the same, and the like. These include polyetheresteramide block copolymers.

Other examples of commercially available polymeric antistatic agents that may be used include "PELECTRON LMP-FS" (trade name) manufactured by SANYO CHEMICAL INDUSTRIES, LTD. and the like. This includes a polyether/polyolefin block copolymer.

The polymeric antistatic agent is preferably contained in the fiber for artificial hair in an amount of 0.5 to 10% by weight. When the content of the polymeric antistatic agent in the fiber for artificial hair is less than 0.5% by weight, antistatic properties become insufficient. When it exceeds 10% by weight, the polymeric antistatic agent migrates from the interior to surface of the fiber material, and tack and blocking are liable to occur. The content of the polymeric antistatic agent in the fiber for artificial hair is preferably 1 to 6% by weight, and more preferably 1.5 to 4% by weight.

The polymeric antistatic agent includes, for example, a block copolymer having a polyether block and a block showing affinity for thermoplastic polyamides, a polyether/polyolefin block copolymer, a polyetheresteramide block copolymer and the like. Among the polymeric antistatic agents, a polyetheresteramide block copolymer is preferred because of its excellent compatibility with polyamides. The preferred among the polyether blocks are polyethylene oxide blocks.

(Polyether/Polyolefin Block Copolymer)

The polyether/polyolefin block copolymer is a block polymer having, for example, a structure such that blocks of the following polyolefin (a) and blocks of the following polyoxyethylene chain (b) are bonded together alternately and repeatedly via at least one bond selected from the group consisting of an ester bond, an amide bond, an ether bond, and an imide bond. Such a block polymer is described in WO 00/47652 A1, the disclosures of which are included herein by reference.

UAs the blocks of polyolefin (a), they may be used polyolefins obtainable by (co)polymerization (which means polymerization or copolymerization, hereinafter the same) of one or a mixture of two or more of olefins having 2 to carbon atoms [those obtainable by a polymerization method] and low-molecular-weight polyolefins obtainable by thermal degradation of high-molecular weight polyolefins (polyolefins obtainable by polymerization of olefins having 2 to 30 carbon atoms) [those obtainable by a thermal degradation method].

The olefins having 2 to 30 carbon atoms include ethylene, propylene, α-olefins having 4 to 30 (preferably 4 to 12, and more preferably 4 to 10) carbon atoms, dienes having 4 to 30 (preferably 4 to 18, and more preferably 4 to 8) carbon atoms and the like.

The α-olefins having 4 to 30 carbon atoms include 1-butene, 4-methyl-1-pentene, 1-pentene, 1-octene, 1-decene, 1-dodecene and the like. The dienes include butadiene, isoprene, cyclopentene, 1,11-dodecadiene and the like.

Preferred among these are olefins having 2 to 12 carbon atoms (ethylene, propylene, α-olefins having 4 to 12 carbon atoms, butadiene and/or isoprene and the like), more preferably olefins having 2 to 10 carbon atoms (ethylene, propylene, α-olefins having 4 to 10 carbon atoms and/or butadiene and the like), and particularly preferred are ethylene, propylene and/or butadiene.

The low-molecular-weight polyolefins obtainable by the thermal degradation method may be easily obtained, for example, by a method described in JP H3(1991)-62804 A.

The polyolefins obtainable by the polymerization method may be produced by a known method, and may be easily obtained, for example, by a method of (co)polymerizing the above olefins in the presence of a radical catalyst, a metal oxide catalyst, a Ziegler catalyst, a Ziegler-Natta catalyst and the like.

The blocks of polyoxyethylene chain (b) include a residue derived from the polyether diol, which is obtained by the addition reaction of an alkylene oxide (having 3 to 12 carbon atoms) with a diol (b01) or dihydric phenol (b02), by removal of hydroxyl groups.

The structure of such a polyether diol may be represented by the general formula: H(OA1)mO-E1-O(A1O)m'H.

In the above formula, E1 represents the residue derived from (b01) or (b02) by removal of the hydroxyl groups, A1 represents an alkylene group having 2 to 12 (preferably 2 to 8, and more preferably 2 to 4) carbon atoms, which essentially contains an alkylene group having two carbon atoms and optionally containing a halogen atom; each of m and m' represents an integer of 1 to 300, preferably 2 to 250, in particular preferably 10 to 100; the m and m' may be the same or different. The m unites of (OA1) and m' unites of (A1O) may be the same or different and, when these are composed of two or more kinds of oxyalkylene group, having ethylene oxide as an essential component, the mode of binding may be block, random or a combination of these.

The diols (b01) include dihydric alcohols (aliphatic, alicyclic or aromatic aliphatic dihydric alcohols) having 2 to 12 (preferably 2 to 10, and more preferably 2 to 8) carbon atoms, tertiary amino group-containing diols having 1 to 12 carbon atoms and the like.

The aliphatic dihydric alcohols include ethylene glycol, propylene glycol, 1,4-butanediol, 1,6-hexanediol, neopentyl glycol and 1,12-dodecanediol.

The alicyclic dihydric alcohols include 1,4-cyclohexanediol, 1,4-cyclohexanedimethanol, 1,4-cyclooctanediol, 1,3-cyclopentanediol and the like.

The aromatic aliphatic dihydric alcohols include xylylenediol, 1-phenyl-1,2-ethanediol, 1,4-bis(hydroxyethyl)benzene and the like.

The tertiary amino group-containing diols include bishydroxyalkylated (number of carbon atoms in the alkyl groups being 1 to 12, preferably 2 to 10, and more preferably 2 to 8) products of aliphatic or alicyclic primary monoamines (having 1 to 12, preferably 2 to 10, and more preferably 2 to 8 carbon atoms), bishydroxyalkylated (number of carbon atoms in alkyl groups being 1 to 12) products of aromatic (aliphatic) primary monoamines (having 6 to 12 carbon atoms), and the like.

Bishydroxyalkylated products of monoamines are readily obtained by known methods, e.g., by reacting monoamines with alkylene oxides having 2 to 4 carbon atoms [ethylene oxide, propylene oxide, butylene oxide, and the like] or by reacting monoamines with hydroxyalkyl halides having 1 to 12 carbon atoms (2-bromoethyl alcohol, 3-chloropropyl alcohol, and the like).

The aliphatic primary monoamines include methylamine, ethylamine, 1- and 2-propylamine, n- and i-amylamine, hexylamine, 1,3-dimethylbutylamine, 3,3-dimethylbutylamine, 2- and 3-aminoheptane, heptylamine, nonylamine, decylamine, undecylamine, dodecylamine, and the like.

The alicyclic primary monoamines include cyclopropylamine, cyclopentylamine, cyclohexylamine and the like.

The aromatic (aliphatic) primary monoamines include aniline, benzylamine and the like.

The dihydric phenols (b02) include those having 6 to 18 (preferably 8 to 18, and more preferably 10 to 15) carbon atoms, for example, monocyclic dihydric phenols (hydroquinone, catechol, resorcin, urushiol and the like), bisphenols (bisphenol A, bisphenol F, bisphenol S, 4,4'-dihydroxydiphenyl-2,2-butane, dihydroxybiphenyl, and the like), and fused polycyclic dihydric phenols (dihydroxynaphthalene, binaphthol, and the like).

Preferred among the (b01) and (b02) from the viewpoint of antistatic properties are dihydric alcohols and dihydric phenols, the more preferred are aliphatic dihydric alcohols and bisphenols, and particularly preferred are ethylene glycol and bisphenol A.

The alkylene oxides to be addition-reacted with the diols (b01) or dihydric phenols (b02) include ethylene oxide, alkylene oxides having 3 to 12 carbon atoms (propylene oxide, 1,2-, 1,4-, 2,3-, and 1,3-butylene oxide, and mixtures of two or more of these). Other alkylene oxides and substituted alkylene oxides may be used in combination if necessary.

From the viewpoint of improving the appearance, feel, and antistatic performance of fibers for artificial hair, preferred among the alkylene oxides is ethylene oxide. In this case, the polymeric antistatic agent becomes a block polymer having a polyethylene oxide structure.

The other alkylene oxides and substituted alkylene oxides include epoxidized products of α-olefins having 5 to 12 carbon atoms, styrene oxides, epihalohydrins (epichlorohydrin, epibromohydrin, and the like). The amount of each of the other alkylene oxides and substituted alkylene oxides used is preferably 30% by weight or less, more preferably 0 or 25% by weight or less, and particularly preferably 0 or 20% by weight or less, based on the weight of all alkylene oxides from the viewpoint of the antistatic properties.

The number of moles of the alkylene oxide added is preferably 1 to 300 moles, more preferably 2 to 250 moles, and particularly preferably 10 to 100 moles per one hydroxyl group of the (b01) or (b02) from the viewpoint of the volume specific resistance value of the polymer (b) having a polyoxyethylene chain. When two or more alkylene oxides are used in combination, the mode of bonding may be random and/or block.

The addition reaction of the alkylene oxide may be carried out by known methods, for example, in the presence of an alkali catalyst (potassium hydroxide, sodium hydroxide or the like) under the conditions of 100 to 200° C. and a pressure of 0 to 0.5 MPaG.

(Polyethersesteramide Block Copolymer)

The polyetheresteramide block copolymer is a polyetheresteramide derived, for example, from the following polyamides (a11) and alkylene oxide adducts of the following bisphenol compounds (a12). Such polyetheresteramides are described in JP H6(1994)-287547 A and JP H4(1992)-5691 B, and the disclosures of which are included herein by reference.

The polyamides (a11) include (1) a lactam ring-opening polymer, (2) a polycondensate of amino carboxylic acid and (3) a polycondensate of a dicarboxylic acid and a diamine.

Among these amide-forming monomers that form polyamides, the lactam in (1) includes those having 6 to 12 carbon atoms, for example, caprolactam, enantholactam, laurolactam, and undecanolactam.

The amino carboxylic acid in (2) includes those having 6 to 12 carbon atoms, for example, ω-aminocaproic acid, ω-aminoenanthic acid, ω-aminocaprylic acid, ω-aminopergonic acid, ω-aminocapric acid, 11-aminoundecanoic acid, and 12-aminododecanoic acid.

The dicarboxylic acid in (3) includes aliphatic dicarboxylic acids, aromatic (aliphatic) dicarboxylic acids, alicyclic dicarboxylic acids, amide-forming derivatives of these [e.g., acid anhydrides and lower alkyl (having 1 to 4 carbon atoms) esters] and mixtures of two or more of these.

The aliphatic dicarboxylic acids include those having 4 to carbon atoms, for example, succinic acid, glutaric acid, adipic acid, pimelic acid, suberic acid, azelaic acid, sebacic acid, undecanedioic acid, dodecanedioic acid, maleic acid, fumaric acid, itaconic acid and the like.

The aromatic (aliphatic) dicarboxylic acids include those having 8 to 20 carbon atoms, for example, ortho-, iso-, and terephthalic acid, naphthalene-2,6- and -2,7-dicarboxylic acid, diphenyl-4,4' dicarboxylic acid, diphenoxyethanedicarboxylic acid, alkali metal (sodium, potassium, and the like) salts of 3-sulfoisophthalic acid and the like.

The alicyclic dicarboxylic acids include those having 7 to 14 carbon atoms, for example, cyclopropanedicarboxylic acid, 1,4-cyclohexanedicarboxylic acid, cyclohexenedicarboxylic acid, dicyclohexyl-4,4-dicarboxylic acid and the like.

Among the amide-forming derivatives, the acid anhydrides include anhydrides of the above dicarboxylic acids, for example, maleic anhydride, itaconic anhydride, phthalic anhydride and the like. The lower alkyl (having 1 to 4 carbon atoms) esters include lower alkyl esters of the above dicarboxylic acids, for example, dimethyl adipate, and dimethyl ortho-, iso- and terephthalate, and the like.

The diamines include those having 6 to 12 carbon atoms, for example, hexamethylenediamine, heptamethylenediamine, octamethylenediamine, decamethylenediamine and the like.

Two or more of those listed above as the amide-forming monomers may be used in combination.

Preferred among these from the viewpoint of antistatic properties are caprolactam, 12-aminododecanoic acid and adipic acid/hexamethylenediamine, and particularly preferred is caprolactam.

The polyamide (a11) is obtained by ring-opening polymerizing or polycondensing the above amide-forming monomers by a conventional method, using one or more dicarboxylic acids having 4 to 20 carbon atoms as molecular weight modifiers, and under their presence.

The dicarboxylic acids having 4 to 20 carbon atoms include those listed in the above (3). Preferred among these from the viewpoint of antistatic properties are aliphatic dicarboxylic acids, aromatic dicarboxylic acids and 3-sulfoisophthalic acid alkali metal salts. The more preferred are adipic acid, sebacic acid, terephthalic acid, isophthalic acid, and sodium 3-sulfoisophthalate.

The amount of the above molecular weight modifier(s) used is preferably 2 to 80% by weight, and more preferably 4 to 75% by weight based on the total weight of the amide-forming monomers and molecular weight modifier(s) from the viewpoint of antistatic properties and heat resistance.

The number-average molecular weight of the polyamide (a11) is preferably 200 to 5,000, and more preferably 500 to 3,000, from the viewpoint of reactivity and heat resistance of the resulting polyetheresteramide.

The bisphenol compound constituting an alkylene oxide adduct of the bisphenol compound (a12) includes those having 13 to 20 carbon atoms, for example, bisphenol A, bisphenol F, and bisphenol S and the like. Among these, preferred is bisphenol A from the viewpoint of dispersibility.

Also, alkylene oxides to be added to bisphenol compounds include those having 2 to 12 carbon atoms, for example, etyhylene oxide, propylene oxide, 1,2-, 2,3- and 1,4-butylene oxide, epoxidized products of α-olefins having 5 to 12 carbon atoms, styrene oxide and epihalohydrins (epichlorohydrin, epibromohydrin and the like), mixtures of two or more of these and the like.

From the viewpoint of improving the appearance, feel, and antistatic performance of fibers for artificial hair, preferred among the above alkylene oxides is ethylene oxide. In this case, the polymeric antistatic agent becomes a block polymer having a polyethylene oxide structure.

The number-average molecular weight of the alkylene oxide adduct of bisphenol compound (a12) is preferably 300 to 5,000, and more preferably 500 to 4,000 from the viewpoint of antistatic properties.

The percentage of the (a12) based on the total weight of the (a11) and the (a12) is preferably 20 to 80% by weight, and more preferably 30 to 70% by weight, from the viewpoint of the antistatic properties and heat resistance of the polyetheresteramide.

The production method of the polyetheresteramide specifically includes the following production methods (1) and (2), but it is not particularly limited.

Production Method (1): A method in which amide-forming monomers are reacted with a dicarboxylic acid (molecular weight modifier) to form (a11), to which (a12) is added, and then the polymerization reaction is carried out at a high temperature (160 to 270° C.) and under reduced pressure (0.03 to 3 kPa).

Production Method (2): A method in which amide-forming monomers and a dicarboxylic acid (molecular weight modifier) and (a12) are simultaneously charged in a reaction tank, and reacted under pressure (0.1 to 1 MPa) at a high temperature (160 to 270° C.) in the presence or absence of water to form an intermediate (a11), and then the polymerization reaction with (a12) is carried out under reduced pressure (0.03 to 3 kPa).

Among the above production methods, production method (1) is preferred from the viewpoint of reaction control.

In addition to the above, as the production method of the polyetheresteramide, a method may be used in which a terminal hydroxyl group of (a12) is substituted with an amino group or carboxyl group, followed by reacting with polyamide having a carboxyl or amino group at an end.

The method of substituting the terminal hydroxyl group of the alkylene oxide adduct of the bisphenol compound (a12) with an amino group includes known methods, such as a method of reducing a terminal cyanoalkyl group obtained by cyanoalkylating a hydroxyl group to an amino group [e.g., a method of reacting the (a12) with acrylonitrile and then hydrogenating the resulting cyanoethylated product], and the like.

The method of substituting the terminal hydroxyl group of the alkylene oxide adduct of the bisphenol compound (a12) with a carboxyl group includes a method of oxidizing it with an oxidant [e.g., a method of oxidizing the hydroxyl group of the (a12) with chromic acid], and the like.

In the above polymerization reaction, publicly known esterification catalysts normally used are used. The catalysts include antimony catalysts (antimony trioxide and the like), tin catalysts (monobutyltin oxide and the like), titanium catalysts (tetrabutyltitanate and the like), zirconium catalysts (tetrabutyl zirconate and the like), metal acetate catalysts (zinc acetate, zirconyl acetate and the like), and the like.

The amount of the catalyst used is preferably 0.1 to 5% by weight based on the total weight of the (a11) and the (a12), and more preferably 0.2 to 3% by weight from the viewpoint of reactivity and resin physical properties.

The polyetheresteramide block copolymer is preferably a condensation product of polyamide having carboxyl groups at both ends and an aromatic ring-containing polyether diol. The aromatic ring moieties of the aromatic ring-containing polyether diol specifically include residues of dihydric phenols selected from bisphenols, monocyclic dihydric phenols, dihydroxybiphenyls, dihydroxynaphthalenes, and binaphthols. Among them, the preferred aromatic moiety is a residue of bisphenols.

The aromatic ring-containing polyether diol has aromatic ring moieties, so that the heat resistance of the polyetheresteramide block copolymer is improved, and the degradation and deterioration during the spinning process are easily prevented. The melting point of the polyetheresteramide block copolymer is also easily adjusted to a temperature appropriate for spinning.

The above polyamides having carboxyl groups at both ends may be, for example, (1) a lactam ring-opening polymer, (2) a polycondensate of amino carboxylic acid or (3) a polycondensate of a dicarboxylic acid and a diamine. The above polyamides having carboxyl groups at both ends have, for example, a number-average molecular weight of 500 to 5,000, and preferably 800 to 3,000. When the number-average molecular weight is less than 500, the heat resistance of the polyetheresteramide itself is reduced, and when it exceeds 5,000, reactivity is reduced and thus a great amount of time is required during the production of the polyetheresteramide.

The above aromatic-containing polyether diol may be, for example, a polyether diol produced by addition reacting an alkylene oxide with an aromatic ring-containing diol. The number of moles of the alkylene oxide added is usually 1 to 30 moles, and preferably 2 to 20 moles. The above aromatic-containing polyether diol has, for example, a number-average molecular weight of 500 to 5,000, and preferably 800 to 3,000. If the number-average molecular weight is less than 500, antistatic properties are insufficient, and if it exceeds 5,000, reactivity is reduced and thus a great amount of time is required during the production of the polyetheresteramide.

Polyetheresteramide block copolymers is preferably substantially free of antistatic components comprising metal salts such as halides of alkali metals or alkaline earth metals. If these are contained in an amount that enhances antistatic properties, they migrate to the surface of the resulting fiber for artificial hair and deposit, so that poor appearance of the artificial hair is liable to occur.

(Thermoplastic Polyester)

The fiber for artificial hair of the present invention preferably comprises a thermoplastic polyamide and a thermoplastic polyester which is incompatible with and has a higher melting point than the thermoplastic polyamide. Here, incompatibility means that two resins do not melt to be a homogeneous resin. Because of that, fibers for artificial hair having a glossy feeling with suppressed luster similar to natural hair are formed. Examples of the thermoplastic polyesters include polyethylene terephthalate, polybutylene terephthalate and the like.

In other words, in one preferred embodiment, the fiber for artificial hair of the present invention comprises a thermoplastic polyamide that forms matrix, a polyester that forms domain and the polymeric antistatic agent, and has concavoconvex configuration formed on its surface, wherein convex portions in the concavoconvex configuration is formed of the thermoplastic polyester. Polyester domains do not precipitate on the fiber surface. The weight ratio of the thermoplastic polyamide to the thermoplastic polyester of the above fiber for artificial hair may be, for example, such that the thermoplastic polyamide may account for half or more to all, preferably in the range of 70/30 to 95/5, and more preferably 75/25 to 85/15.

<Method for Producing Fiber for Artificial Hair>

The fiber for artificial hair of the present invention may be produced according to a method similar to that for the conventional fiber for artificial hair, except that the thermoplastic polyamide contains the above polymeric antistatic agent. The fiber for artificial hair of the present invention may be produced according to the method described in, for example, Patent Document 1. The disclosures of Patent Document 1 are included herein by reference.

Specifically, the fiber for artificial hair of the present invention may be produced by melt-mixing a thermoplastic polyamide and a polymeric antistatic agent at a melting temperature equal to or higher than the melting points of these, extruding the melt-mixed resin at a discharge temperature equal to or lower than the above melting temperature, and forming it into a fibrous form.

In one preferred embodiment, the fiber for artificial hair of the present invention may be produced by melt-mixing a thermoplastic polyamide, a polyester which is incompatible with and has a higher melting point than the thermoplastic polyamide, and a polymeric antistatic agent at a melting temperature equal to or higher than the melting points of these three components, extruding the melt-mixed resin at a discharge temperature equal to lower than the above melting temperature, and forming it into a fibrous form.

FIG. 1 shows a common spinning apparatus using a single-screw extruder used for the production of synthetic fibers used in the present invention. The apparatus is composed of a hopper 1 for charging resin, a cylinder 2 for heating the charged resin, a screw 3 for melt-kneading the resin to send it to a discharge section, and a gear pump 4 for sending the melt-mixed resin to a spinneret section 5. The melt-mixed resin is discharged from the spinneret section 5 in a thread-like form and spun. As for the number of screws, there are single or multiple screws, which may be selected as appropriate depending on the characteristics of the resin and the thickness of fibers to be formed.

Figure 2:
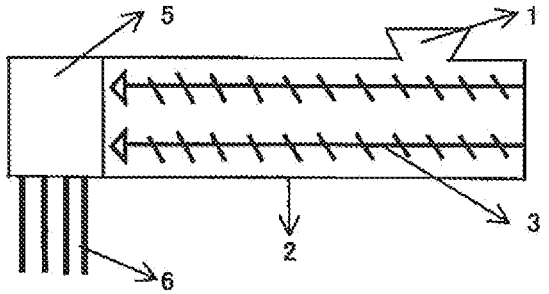
FIG. 2 is a schematic view of a common twin-screw extruder used for the production of synthetic fibers used in the present invention.

In the spinning apparatus used for the production of synthetic fibers, which is used in the present invention, a configuration is generally used in which a single- or twin-screw extruder as shown in FIG. 1 or FIG. 2 is used to deliver the melt-mixed resin to the spinneret section. The gear pump 4 used in the single-screw extruder shown in FIG. 1 is not used in the twin-screw extruder in FIG. 2. However, as shown in FIG. 2, even a configuration with the gear pump removed does not affect the formation of convex portions on the surface of the artificial hair of the resin serving as the matrix. The system without a boosting function in FIG. 2 may be preferably employed for the reason that the residence time of the melt-mixed resin in the spinning apparatus is shortened to reduce thermal degradation of the resin.

The resin mixed at a predetermined weight ratio within the above range is melted at a predetermined set temperature equal to or higher than the melting point of the thermoplastic polyester (this temperature is referred to as a melt set temperature T1). Pigments and/or dyes may be added to color them when mixing these. Furthermore, stabilizers and antioxidants and/or ultraviolet absorbers may be added. These may be either directly charged into the spinning apparatus, or a master batch in which they are kneaded into a polyamide resin or a polyester resin beforehand may be charged.

The thermoplastic resin supplied from the hopper 1 is melted and delivered from the cylinder 2 to the spinneret section 5 with the single or twin screw 3. The temperature of the melt-mixed resin is preferably the same as the melt set temperature T1 or higher than the melt set temperature T1, but it may be lower than the melt set temperature T1 as long as the temperature is in the range in which the melted resin does not solidify.

Figure 3:
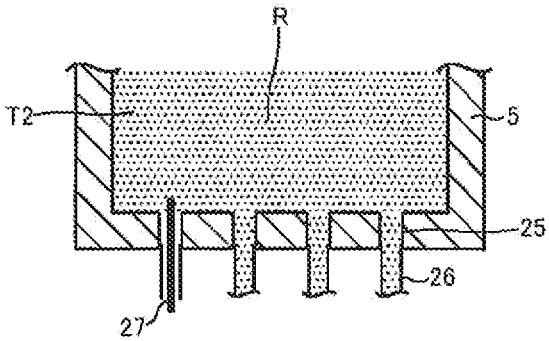
FIG. 3 is a schematic view of a spinneret in FIGS. 1 and 2.

FIG. 3 shows a schematic view of the spinneret section 5. In the figure, symbol 25 is a discharge opening for resin, symbol 26 is a resin discharged from a discharge opening 25, and symbol 27 is a temperature sensor inserted into the discharge opening of the spinneret section 5 and placed in the vicinity position thereof. T2 is a temperature of the resin R in a melted state before discharge measured by the temperature sensor. The temperature of the melted resin before discharge is defined as T2, and the resin discharge temperature of the spinneret section 5, namely the spinneret set temperature is defined as T3.

When the mixed resin is kneaded by the screw in the spinning apparatus, the melted resin generally generates heat so that the melted resin temperature T2 becomes higher than the melt set temperature T1. If the melted resin temperature T2 before discharge becomes excessively higher than the melt set temperature T1, the resin surface discharged from the spinneret section 5 may result in the formation of small convex portions of the first thermoplastic resin, or no formation of convex portions of the first thermoplastic resin, the both of which being not preferred. Conversely, if the melted resin temperature T2 before discharge is excessively lower than the melt set temperature T1, the viscosity of the mixed resin becomes high and it does not flow, so that it may not be discharged, which is not preferred.

The spinneret set temperature T3 may be set to a temperature lower than the melted resin temperature T2 in the vicinity position of the discharge opening, and preferably about 20 to 30° C. lower than the melt set temperature T1. If the temperature is higher than this range, concavoconvex on the surface of the discharged resin is hardly formed. Conversely, if it is lower than that, the resin easily solidifies, which is not preferred.

More preferably, the spinneret set temperature T3 is set equal to or lower than the melting point of the thermoplastic polyester. The spinneret set temperature T3 is preferably lower than the melting point of the thermoplastic polyester in the range of 5° C. or higher and 30° C. or lower. Still more preferably, the spinneret set temperature T3 is set lower than the melting point of the thermoplastic polyester in the range of 10° C. to 30° C. If the temperature is higher than this range, concavoconvex on the surface of the discharged resin is hardly formed. Conversely, if the temperature becomes lower than this range, the resin easily solidifies, which is not preferred.

The spinneret used does not require any special structure, and a spinneret of known structure is sufficient to obtain the synthetic fiber used in the present invention.

Figure 4:
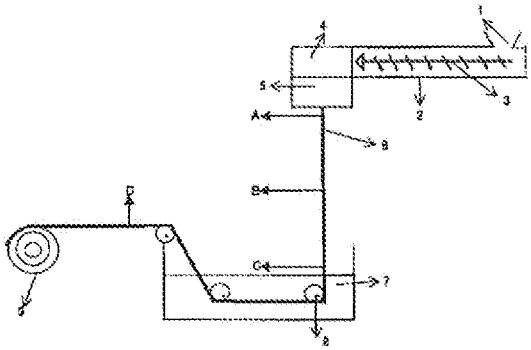
FIG. 4 is a drawing showing an outline of the process from spinning to winding up a synthetic fiber used in the present invention.

FIG. 4 shows an outline of the process from spinning to winding up a fiber according to the invention.

A fibrous discharged resin 6 discharged from the spinneret section 5 via gear pump 4 of the spinning apparatus under the above temperature conditions is air cooled (ranges of A, B and C in the figure), water cooled in a cooling water tank 7 and wound up by a winder 9. Although FIG. 4 shows a process in which water cooling is performed, the discharged resin 6 may be cooled by air cooling alone and wound up. The spinning apparatus may also be one shown in FIG. 2, not using the gear pump.

The melted resin discharged from the discharge openings 25 of the spinning apparatus is fluid and can be drawn under tension. However, the discharged resin is cooled, as a result of which the solidification of the resin progresses, and the fluidity of the resin decreases, eventually making it impossible for it to be drawn unless it is heated. A state in which the resin discharged from the discharge openings may be drawn under tension generated by the set wind-up speed is defined as the elongational flow range. The elongational flow range is not constant and varies depending on the resin used, the set temperature of the spinneret, the temperature of the installation site of the spinning apparatus, and the wind-up speed.

When the spinneret set temperature T3 is set lower than the melt set temperature T1, domains do not deposit on the fiber surface, but are covered with the matrix resin component or small convex portions formed of the matrix component are formed on the fiber surface. In particular, if the spinneret set temperature T3 is lower than the melting point of the domain component, many small convex portions covered with the matrix are formed.

The wound up synthetic fiber is drawn to a predetermined yarn diameter, for example, a yarn diameter of 80 μm, through drawing rollers of a drawing apparatus and a dry heat bath. Alternatively, a spinning step and a drawing step may be performed continuously by connecting the spinning apparatus and the drawing apparatus.

<Uses of Wigs, and the Like>

Many drawn fibers for artificial hair may be implanted in a wig base to produce a wig. The wig base may be composed of a net-like base, an artificial skin base, or a combination of these. The drawn fibers for artificial hair may be used for hair for increasing the hair or hair substitutes.

The present invention is further specifically described by the following examples, but the present invention is not limited to these.

EXAMPLES

The following polyetheresteramide block copolymers were prepared as polymeric antistatic agents.

TABLE 1

| | Properties | Structure | Product |
|---|---|---|---|
| Antistatic agent A | Melting point 195° C., MFR 30 g (215° C., 21.18N), surface specific resistance value $4 \times 10^6$, thermal weight loss initiation temperature 285° C. | Condensation product of polyamide having carboxyl groups at both ends and aromatic ring-containing polyethylene glycol, containing metal salt antistatic components | "PELECTRON AS" (trade name) manufactured by Sanyo Chemical Industries, Ltd. |

TABLE 1-continued

| | Properties | Structure | Product |
|---|---|---|---|
| Antistatic agent B | Melting point 203° C., MFR 20 g (215° C., 21.18N), surface specific resistance value $1 \times 10^9$ thermal weight loss initiation temperature 285° C. | Condensation product of polyamide having carboxyl groups at both ends and aromatic ring-containing polyethylene glycol | "PELESTAT NC6321" (trade name) manufactured by Sanyo Chemical Industries, Ltd. |

TABLE 2

| | Properties | Structure | Product |
|---|---|---|---|
| Antistatic agent C | Melting point 176° C., MFR 10 g (190° C., 21.18N), surface specific resistance value $2 \times 10^9$, thermal weight loss initiation temperature 280° C. | Condensation product of polyamide having carboxyl groups at both ends and aromatic ring-containing polyethylene glycol | "PELESTAT NC 7530" (trade name) manufactured by Sanyo Chemical Industries, Ltd. |
| Antistatic agent D | Melting point 191° C., MFR 20 g (215° C., 21.18N), surface specific resistance value $1 \times 10^8$, thermal weight loss initiation temperature 285° C. | Condensation product of polyamide having carboxyl groups at both ends and aromatic ring-containing polyethylene glycol | "PELESTAT 6500" (trade name) manufactured by Sanyo Chemical Industries, Ltd. |
| Antistatic agent E | Melting point 193° C., MFR 30 g (215° C., 21.18N), surface specific resistance value $1 \times 10^8$, thermal weight loss initiation temperature 285° C. | Condensation product of polyamide having carboxyl groups at both ends and aromatic ring-containing polyethylene glycol | "PELESTAT 6200" (trade name) manufactured by Sanyo Chemical Industries, Ltd. |
| Antistatic agent F | Melting point 115° C., MFR 15 g (190° C., 21.18N), surface specific resistance value $3 \times 10^6$, thermal weight loss initiation temperature 250° C. | Block copolymer having polyethylene oxide block and polyolefin-based block | "PELECTRON LMP-FS" (trade name) manufactured by Sanyo Chemical Industries, Ltd. |

Example 1

VESTAMID D-18 (trade name, melting point 200 to 225° C., MFR 25.8 g (240° C., 21.18 N)) manufactured by Daicel-Evonik, Inc. as thermoplastic polyamide (hereinafter referred to as "PA"), and "Vyropet BR-3067" (trade name, melting point 255° C.) manufactured by TOYOBO CO., LTD. as thermoplastic polyester (hereinafter referred to as "PE") were prepared in an amount such that the PA/PE ratio was 85/15. Antistatic agent A (hereinafter referred to as "agent A") in an amount of 1% by weight and a colorant in an amount of 0.49% by weight based on the resin components were prepared.

The prepared raw materials, the spinning apparatus shown in FIG. 4, and the drawing apparatus (not shown) were used to produce fibers for artificial hair. In the following production conditions, T1 is the melt set temperature, T2 is the melt resin temperature near the spinneret, and T3 is the spinneret set temperature.

(Production Conditions)

T1/T2/T3 (° C.): 280/248/248
Spinning discharge rate (kg/h): 0.4
Cooling water temperature (° C.): 5
Spinning take-up speed (m/min): 120
Room temperature in experiment site (° C.): 26
Draw ratio (times): 4.4
Draw temperature (° C., air): 90, 190

Hair bundles were prepared by bundling 2 g of fibers for artificial hair. They were formed to a hair extension member by using a sewing machine, and was immersed in a silicone solution (silicone agent:water/1:60), spread over a nonwoven fabric that was similarly immersed, then wound around a 35 mm aluminum pipe, and covered with an aluminum foil thereon. They were curled by heat treatment at 180° C. for 2 hours. The curled hair bundles were left to stand on a flat surface, to form circles. The diameter (mm) of the inner circumference of the circles formed by the hair bundles was measured. This value is defined as a curl dimension. The measurement results are shown in Table 3.

Examples 2 to 90

Figure 5:
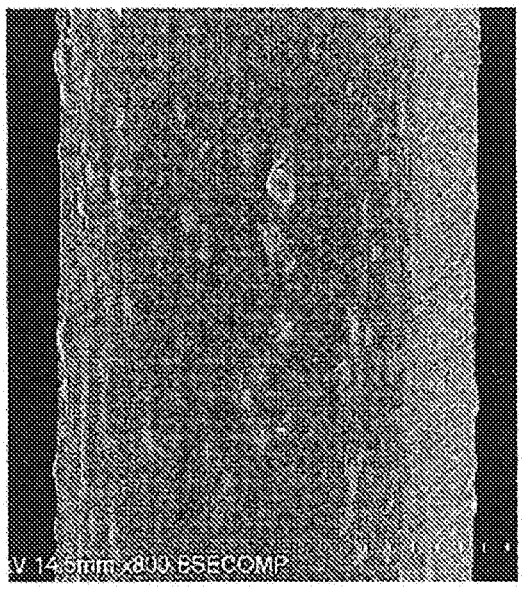
FIG. 5 is an 800 times magnified image showing the surface of a fiber for artificial hair in Example 16.
Figure 6:
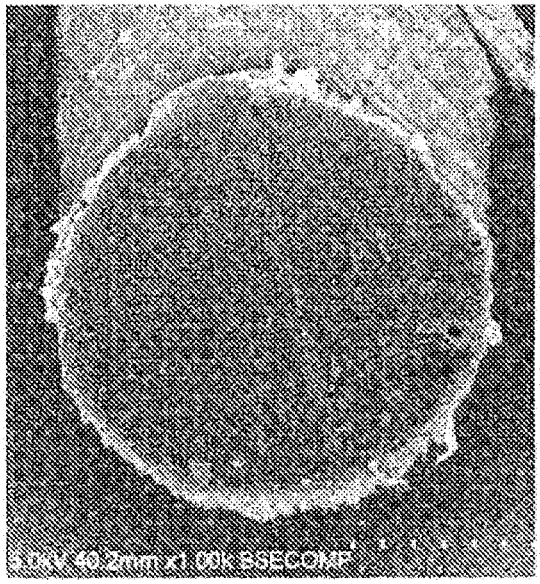
FIG. 6 is a 1,000 times magnified image showing a cross-sectional surface of a fiber for artificial hair in Example 16.

Fibers for artificial hair were produced in the same manner as in Example 1, except that the PA/PE ratio, type and amount of the antistatic agent used, and T2 and T3 were changed. Magnified images of a fiber for artificial hair of Example 16 are shown in FIGS. 5 and 6. FIG. 5 is an 800 times magnified image showing the surface of the fiber for artificial hair. FIG. 6 is a 1,000 times magnified image showing a cross-sectional surface of the fiber for artificial hair. It can be seen from FIG. 5 that convex portions project indefinitely to form concavoconvex on the surface of the fiber for artificial hair. It can be seen from FIG. 6 that the morphology of the fiber for artificial hair forms a sea-island structure in which polyester island portions are almost uniformly dispersed in the polyamide sea portion.

In the same manner as in Example 1, hair bundles of the produced fibers for artificial hair were prepared, curled, and the curl diameters (mm) were measured. The results are shown in Tables 3 through 14.

TABLE 3

| | Examples | | | | | |
|---|---|---|---|---|---|---|
| | 1 | 2 | 3 | 4 | 5 | 6 |
| PA/PE ratio | 85/15 | 85/15 | 81/19 | 81/19 | 75/25 | 75/25 |
| Agent A (%) | 1 | — | 1 | — | 1 | — |
| Agent B (%) | — | 1 | — | 1 | — | 1 |
| T2 and T3 (° C.) | 248 | 248 | 248 | 248 | 248 | 248 |
| Curl diameter (mm) | 41.6 | 38.8 | 39.1 | 35.9 | 33.4 | 31.6 |

TABLE 4

| | Examples | | | | | |
|---|---|---|---|---|---|---|
| | 7 | 8 | 9 | 10 | 11 | 12 |
| PA/PE ratio | 85/15 | 85/15 | 81/19 | 81/19 | 75/25 | 75/25 |
| Agent A (%) | 1 | — | 1 | — | 1 | — |
| Agent B (%) | — | 1 | — | 1 | — | 1 |
| T2 and T3 (° C.) | 250 | 250 | 250 | 250 | 250 | 250 |
| Curl diameter (mm) | 42.7 | 39.7 | 41.2 | 38.4 | 38.1 | 36.5 |

TABLE 5

| | Examples | | | | | |
|---|---|---|---|---|---|---|
| | 13 | 14 | 15 | 16 | 17 | 18 |
| PA/PE ratio | 85/15 | 85/15 | 81/19 | 81/19 | 75/25 | 75/25 |
| Agent A (%) | 3 | — | 3 | — | 3 | — |
| Agent B (%) | — | 3 | — | 3 | — | 3 |

TABLE 5-continued

| | Examples | | | | | |
|---|---|---|---|---|---|---|
| | 13 | 14 | 15 | 16 | 17 | 18 |
| T2 and T3 (° C.) | 248 | 248 | 248 | 248 | 248 | 248 |
| Curl diameter (mm) | 41.2 | 38.5 | 38.9 | 35.1 | 32.7 | 30.8 |

TABLE 6

| | Examples | | | | | |
|---|---|---|---|---|---|---|
| | 19 | 20 | 21 | 22 | 23 | 24 |
| PA/PE ratio | 85/15 | 85/15 | 81/19 | 81/19 | 75/25 | 75/25 |
| Agent A (%) | 3 | — | 3 | — | 3 | — |
| Agent B (%) | — | 3 | — | 3 | — | 3 |
| T2 and T3 (° C.) | 250 | 250 | 250 | 250 | 250 | 250 |
| Curl diameter (mm) | 41.8 | 39.1 | 40.1 | 37.1 | 37.3 | 36.3 |

TABLE 7

| | Examples | | | | | |
|---|---|---|---|---|---|---|
| | 25 | 26 | 27 | 28 | 29 | 30 |
| PA/PE ratio | 85/15 | 85/15 | 81/19 | 81/19 | 75/25 | 75/25 |
| Agent A (%) | 5 | — | 5 | — | 5 | — |
| Agent B (%) | — | 5 | — | 5 | — | 5 |
| T2 and T3 (° C.) | 248 | 248 | 248 | 248 | 248 | 248 |
| Curl diameter (mm) | 39.7 | 37.9 | 36.2 | 34.3 | 31.8 | 30.5 |

TABLE 8

| | Examples | | | | | |
|---|---|---|---|---|---|---|
| | 31 | 32 | 33 | 34 | 35 | 36 |
| PA/PE ratio | 85/15 | 85/15 | 81/19 | 81/19 | 75/25 | 75/25 |
| Agent A (%) | 5 | — | 5 | — | 5 | — |
| Agent B (%) | — | 5 | — | 5 | — | 5 |
| T2 and T3 (° C.) | 250 | 250 | 250 | 250 | 250 | 250 |
| Curl diameter (mm) | 39.9 | 38.4 | 38.8 | 35.9 | 36.3 | 34.0 |

TABLE 9

| | Examples | | | | | | | | |
|---|---|---|---|---|---|---|---|---|---|
| | 37 | 38 | 39 | 40 | 41 | 42 | 43 | 44 | 45 |
| PA/PE ratio | 85/15 | 85/15 | 85/15 | 81/19 | 81/19 | 81/19 | 75/25 | 75/25 | 75/25 |
| Agent C (%) | 1 | — | — | 1 | — | — | 1 | — | — |
| Agent D (%) | — | 1 | — | — | 1 | — | — | 1 | — |
| Agent E (%) | — | — | 1 | — | — | 1 | — | — | 1 |
| T2 and T3 (° C.) | 248 | 248 | 248 | 248 | 248 | 248 | 248 | 248 | 248 |
| Curl diameter (mm) | 36.7 | 36.1 | 38.1 | 38.8 | 38.1 | 40.8 | 32.4 | 31.7 | 38.9 |

TABLE 10

| | Examples | | | | | | | | |
|---|---|---|---|---|---|---|---|---|---|
| | 46 | 47 | 48 | 49 | 50 | 51 | 52 | 53 | 54 |
| PA/PE ratio | 85/15 | 85/15 | 85/15 | 81/19 | 81/19 | 81/19 | 75/25 | 75/25 | 75/25 |
| Agent C (%) | 1 | — | — | 1 | — | — | 1 | — | — |
| Agent D (%) | — | 1 | — | — | 1 | — | — | 1 | — |
| Agent E (%) | — | — | 1 | — | — | 1 | — | — | 1 |
| T2 and T3 (° C.) | 250 | 250 | 250 | 250 | 250 | 250 | 250 | 250 | 250 |
| Curl diameter (mm) | 40.8 | 39.1 | 42.2 | 41.1 | 39.3 | 42.3 | 37.0 | 36.5 | 41.0 |

TABLE 11

| | Examples | | | | | | | | |
|---|---|---|---|---|---|---|---|---|---|
| | 55 | 56 | 57 | 58 | 59 | 60 | 61 | 62 | 63 |
| PA/PE ratio | 85/15 | 85/15 | 85/15 | 81/19 | 81/19 | 81/19 | 75/25 | 75/25 | 75/25 |
| Agent C (%) | 3 | — | — | 3 | — | — | 3 | — | — |
| Agent D (%) | — | 3 | — | — | 3 | — | — | 3 | — |
| Agent E (%) | — | — | 3 | — | — | 3 | — | — | 3 |
| T2 and T3 (° C.) | 248 | 248 | 248 | 248 | 248 | 248 | 248 | 248 | 248 |
| Curl diameter (mm) | 40.2 | 39.2 | 41.2 | 36.6 | 35.4 | 39.3 | 31.3 | 31.6 | 32.8 |

TABLE 12

| | Examples | | | | | | | | |
|---|---|---|---|---|---|---|---|---|---|
| | 64 | 65 | 66 | 67 | 68 | 69 | 70 | 71 | 72 |
| PA/PE ratio | 85/15 | 85/15 | 85/15 | 81/19 | 81/19 | 81/19 | 75/25 | 75/25 | 75/25 |
| Agent C (%) | 3 | — | — | 3 | — | — | 3 | — | — |
| Agent D (%) | — | 3 | — | — | 3 | — | — | 3 | — |
| Agent E (%) | — | — | 3 | — | — | 3 | — | — | 3 |
| T2 and T3 (° C.) | 250 | 250 | 250 | 250 | 250 | 250 | 250 | 250 | 250 |
| Curl diameter (mm) | 41.1 | 39.9 | 42.3 | 39.6 | 38.2 | 41.0 | 36.7 | 36.1 | 38.1 |

TABLE 13

| | Examples | | | | | | | | |
|---|---|---|---|---|---|---|---|---|---|
| | 73 | 74 | 75 | 76 | 77 | 78 | 79 | 80 | 81 |
| PA/PE ratio | 85/15 | 85/15 | 85/15 | 81/19 | 81/19 | 81/19 | 75/25 | 75/25 | 75/25 |
| Agent C (%) | 5 | — | — | 5 | — | — | 5 | — | — |
| Agent D (%) | — | 5 | — | — | 5 | — | — | 5 | — |
| Agent E (%) | — | — | 5 | — | — | 5 | — | — | 5 |
| T2 and T3 (° C.) | 248 | 248 | 248 | 248 | 248 | 248 | 248 | 248 | 248 |
| Curl diameter (mm) | 38.8 | 38.2 | 40.8 | 35.2 | 34.6 | 37.2 | 31.7 | 30.7 | 32.3 |

TABLE 14

| | Examples | | | | | | | | |
|---|---|---|---|---|---|---|---|---|---|
| | 82 | 83 | 84 | 85 | 86 | 87 | 88 | 89 | 90 |
| PA/PE ratio | 85/15 | 85/15 | 85/15 | 81/19 | 81/19 | 81/19 | 75/25 | 75/25 | 75/25 |
| Agent C (%) | 5 | — | — | 5 | — | — | 5 | — | — |
| Agent D (%) | — | 5 | — | — | 5 | — | — | 5 | — |

TABLE 14-continued

| | Examples | | | | | | | | |
|---|---|---|---|---|---|---|---|---|---|
| | 82 | 83 | 84 | 85 | 86 | 87 | 88 | 89 | 90 |
| Agent E (%) | — | — | 5 | — | — | 5 | — | — | 5 |
| T2 and T3 (° C.) | 250 | 250 | 250 | 250 | 250 | 250 | 250 | 250 | 250 |
| Curl diameter (mm) | 39.2 | 38.4 | 41.5 | 37.5 | 36.5 | 40.2 | 35.7 | 34.7 | 37.3 |

Comparative Examples 1 to 6

Fibers for artificial hair of Comparative Examples 1 to 6 were produced in the same manner as in Examples 1, 3, 5, 7, 9, and 11, respectively, except that no antistatic agent was used. They were curled, and the curl diameters (mm) were measured. The results are shown in Table 15.

TABLE 15

| | Comparative Examples | | | | | |
|---|---|---|---|---|---|---|
| | 1 | 2 | 3 | 4 | 5 | 6 |
| PA/PE ratio | 85/15 | 81/19 | 75/25 | 85/15 | 81/19 | 75/25 |
| T2 and T3 (° C.) | 248 | 248 | 248 | 250 | 250 | 250 |
| Curl diameter (mm) | 42.7 | 40.5 | 34.8 | 43.7 | 42.0 | 39.4 |

Regarding the produced fibers for artificial hair, a tendency was observed that the fibers for artificial hair of the comparative examples containing no antistatic agent had a larger curl diameter and inferior curling performance when compared to the fibers for artificial hair of the examples with the same production conditions except for the antistatic agent. When the production conditions were changed, the following tendencies were observed in the curling performance of the produced fibers for artificial hair.

TABLE 16

| Production conditions | Tendency of curling performance |
|---|---|
| Type of antistatic agent | Agent B small curl (high) > D > C > A > Agent E large curl (low) |
| Amount of antistatic agent | 5% small curl (high) > 0% large curl (low) |
| T2 and T3 temperature (° C.) | 248° C. small curl (high) > 250° C. large curl (low) |
| PA/PB ratio | 75/25 small curl (high) > 81/19 > 85/15 large curl (low) |

The following findings were also obtained by observing the produced fibers for artificial hair. That is, when agent A was used, the color was more white-toned than when agent B was used. The luster was emphasized when the PA/PE ratio was 85/15. The hair quality was coarse when the PA/PE ratio was 75/25. When T2 and T3 were set at 250° C., the luster was emphasized more than when T2 and T3 were set at 248° C.

Example 91

Fibers for artificial hair were produced in the same manner as in Example 4 (PA/PE ratio 81/19, agent B 1%, T2 and T3 (° C.) 248), except that the amount of the antistatic agent used was changed; hair bundles were prepared, and curled. The curled hair bundles were brushed 10 times using a Denman-type metal comb brush. The amount of static electricity charged on the hair bundles and the curl diameter of the hair bundles (mm) were measured using a static electricity measuring instrument "FMX-004" (trade name) manufactured by SIMCO JAPAN.

A shampoo "AD&F PRO STYLING" (trade name) manufactured by Aderans Co., Ltd. was applied to the entire hair bundles, then the hair bundles were washed by rinsing them off with water, and drying them by applying air at about 60° C. The dried hair bundles were brushed 10 times, and the amount of static electricity charged on the hair bundles, and the curl diameter (mm) of the hair bundles were measured (number of washes 1).

Washing and drying of the hair bundles was repeated 4 more times, brushing was carried out 10 times, and the amount of static electricity charged on the hair bundles and the curl diameter (mm) of the hair bundles were measured (number of washes: 5). Washing and drying of the hair bundles was repeated 5 more times, brushing was carried out 10 times, and the amount of static electricity charged on the hair bundles and the curl diameter (mm) of the hair bundles were measured (number of washes: 10). The results are shown in Tables 17 through 20.

TABLE 17

| | After brushing 10 times, maximum absolute value of amount of static electricity | | | |
|---|---|---|---|---|
| | Number of washes | | | Unit: kV |
| | Before washing | 1 Wash | 5 Washes | 10 Washes |
| Agent B 1% | 5.6 | 5.8 | 8.1 | 9.0 |
| Agent B 2% | 5.1 | 5.6 | 6.3 | 7.3 |
| Agent B 3% | 2.3 | 2.7 | 3.8 | 4.3 |
| Agent B 4% | 1.0 | 2.0 | 3.0 | 3.6 |
| Agent B 5% | 0.3 | 0.3 | 0.6 | 0.8 |
| Agent B 0% | 6.5 | 6.8 | 8.2 | 11 |

TABLE 18

| | After brushing 10 times, maximum absolute value of amount of static electricity | | | |
|---|---|---|---|---|
| | Number of washes | | | Unit: kV |
| | Before washing | 1 Wash | 5 Washes | 10 Washes |
| Agent A 1% | 4.0 | 5.2 | 6.1 | 7.6 |
| Agent A 3% | 1.6 | 1.6 | 2.6 | 3.5 |
| Agent A 5% | 0.2 | 0.3 | 0.5 | 0.6 |
| Agent C 1% | 5.4 | 6.7 | 8.3 | 10.7 |
| Agent C 3% | 4.3 | 5.5 | 6.4 | 8.9 |
| Agent C 5% | 3.2 | 4.1 | 4.2 | 6.4 |

TABLE 18-continued

| | After brushing 10 times, maximum absolute value of amount of static electricity | | | |
|---|---|---|---|---|
| | Number of washes | | | Unit: kV |
| | Before washing | 1 Wash | 5 Washes | 10 Washes |
| Agent D 1% | 3.7 | 6.2 | 8.0 | 8.5 |
| Agent D 3% | 2.6 | 3.1 | 4.4 | 5.8 |
| Agent D 5% | 0.5 | 0.6 | 0.8 | 0.8 |
| Agent E 1% | 4.8 | 6.6 | 8.2 | 10.5 |
| Agent E 3% | 3.1 | 4.5 | 5.2 | 7.9 |
| Agent E 5% | 1.5 | 2.4 | 2.7 | 3.1 |

TABLE 19

| | After brushing 10 times, curl diameter Number of washes | | | |
|---|---|---|---|---|
| | Before washing | 1 Wash | 5 Washes | 10 Washes |
| Agent B 1% | 35.5 | 35.9 | 40.5 | 41.8 |
| Agent B 2% | 35.3 | 35.8 | 40.1 | 41.6 |
| Agent B 3% | 34.7 | 35.1 | 39.0 | 40.5 |
| Agent B 4% | 34.4 | 34.7 | 38.0 | 40.1 |
| Agent B 5% | 34.0 | 34.3 | 37.5 | 39.7 |
| Agent B 0% | 35.7 | 40.5 | 41.6 | 43.3 |

TABLE 20

| | After brushing 10 times, curl diameter Number of washes | | | |
|---|---|---|---|---|
| | Before washing | 1 Wash | 5 Washes | 10 Washes |
| Agent A 1% | 36.0 | 39.1 | 40.5 | 42.0 |
| Agent A 3% | 35.3 | 38.9 | 40.3 | 41.4 |
| Agent A 5% | 35.0 | 36.2 | 39.2 | 40.7 |
| Agent C 1% | 35.6 | 38.1 | 40.8 | 42.4 |
| Agent C 3% | 35.7 | 36.6 | 39.8 | 41.3 |
| Agent C 5% | 35.1 | 35.2 | 39.5 | 40.1 |
| Agent D 1% | 35.4 | 36.4 | 40.5 | 41.7 |
| Agent D 3% | 34.9 | 35.4 | 39.4 | 40.8 |
| Agent D 5% | 34.4 | 34.6 | 39.3 | 40.0 |
| Agent E 1% | 36.1 | 39.5 | 40.6 | 42.3 |
| Agent E 3% | 35.4 | 39.3 | 40.6 | 41.5 |
| Agent E 5% | 35.3 | 37.2 | 39.5 | 41.1 |

Fibers for artificial hair containing no antistatic agent greatly expanded in curl diameter from the first wash, and curl retention performance when repeatedly washing was inferior.

Examples 92 to 94

Fibers for artificial hair were produced in the same manner as in Example 1, except that the PA/PE ratio, type and amount of the antistatic agent used, and T2 and T3 were changed. In the same manner as in Example 1, hair bundles of the produced fibers for artificial hair were prepared, curled, and the curl diameters (mm) were measured. The results are shown in Table 21.

TABLE 21

| | Examples | | | | | |
|---|---|---|---|---|---|---|
| | 92 | 93 | 94 | 95 | 96 | 97 |
| PA/PE ratio | 81/19 | 81/19 | 81/19 | 81/19 | 81/19 | 81/19 |
| Agent F (%) | 1 | 3 | 5 | 1 | 3 | 5 |
| T2 and T3 (° C.) | 248 | 248 | 248 | 250 | 250 | 250 |
| Curl diameter (mm) | 39.8 | 39.0 | 37.4 | 41.8 | 40.9 | 40.1 |

Examples 98 to 103

Fibers for artificial hair were produced in the same manner as in Example 1, except that only PA was used in place of PA and PE as the resin component, and that the type, amount of the antistatic agent used, and T2 and T3 were changed. In the same manner as in Example 1, hair bundles of the produced fibers for artificial hair were prepared, curled, and the curl diameters (mm) were measured. The results are shown in Table 22.

TABLE 22

| | Examples | | | | | |
|---|---|---|---|---|---|---|
| | 98 | 99 | 100 | 101 | 102 | 103 |
| PA/PE ratio | 100/0 | 100/0 | 100/0 | 100/0 | 100/0 | 100/0 |
| Agent B (%) | 1 | 3 | 5 | 1 | 3 | 5 |
| T2 and T3 (° C.) | 248 | 248 | 248 | 250 | 250 | 250 |
| Curl diameter (mm) | 48.8 | 48.0 | 46.7 | 50.7 | 49.6 | 48.7 |

Comparative Examples 7 and 8

Fibers for artificial hair of Comparative Examples 7 and 8 were produced in the same manner as in Examples 98 and 101, respectively, except that no antistatic agent was used; they were curled, and the curl diameters (mm) were measured. The results are shown in Table 23.

TABLE 23

| | Comparative Examples | |
|---|---|---|
| | 7 | 8 |
| PA/PE ratio | 100/0 | 100/0 |
| T2 and T3 (° C.) | 248 | 250 |
| Curl diameter (mm) | 51.0 | 52.5 |

Example 104

The curled hair bundles obtained in Examples 92 to 94, 98 to 100, and Comparative Example 7 were brushed 10 times using a Denman-type metal comb brush. The amount of static electricity charged on the hair bundles and the curl diameter of the hair bundles (mm) were measured using the static electricity measuring instrument "FMX-004" (trade name) manufactured by Simco Japan.

The shampoo "AD&F PRO STYLING" (trade name) manufactured by Aderans Co., Ltd. was applied to the entire hair bundles, then the hair bundles were washed by rinsing them off with water, and drying them by applying air at about 60° C. The dried hair bundles were brushed 10 times, and the amount of static electricity charged on the hair bundles and the curl diameter (mm) of the hair bundles were measured (number of washes 1).

The hair bundles were washed and dried four more times, brushed 10 times, and the amount of static electricity charged on the hair bundles and the curl diameter (mm) of the hair bundles were measured (number of washes: 5). The hair bundles were washed and dried 5 more times, brushed 10 times, and the amount of static electricity charged on the hair bundles and the curl diameter (mm) of the hair bundles were measured (number of washes: 10). The results are shown in Tables 24 and 25. In Tables 24 and 25, the numbers after PA and PE indicate the weight ratio of each component with the weight of the artificial hair fibers being 100.

TABLE 24

| | After brushing 10 times, maximum absolute value of amount of static electricity | | | |
|---|---|---|---|---|
| | Number of washes | | | Unit: kV |
| | Before washing | 1 Wash | 5 Washes | 10 Washes |
| PA 81/PE 19/Agent F 1% | 5.1 | 6.3 | 8.0 | 9.5 |
| PA 81/PE 19/Agent F 3% | 3.1 | 4.2 | 5.0 | 6.3 |
| PA 81/PE 19/Agent F 5% | 0.6 | 1.0 | 1.4 | 2.0 |
| PA 100% | 8.0 | 8.8 | 10.7 | 13.8 |
| PA 100/PE 0/Agent B 1% | 6.2 | 6.6 | 8.5 | 10.0 |
| PA 100/PE 0/Agent B 3% | 3.7 | 4.2 | 4.9 | 6.6 |
| PA 100/PE 0/Agent B 5% | 0.9 | 1.4 | 1.8 | 2.4 |

TABLE 25

| | After brushing 10 times, curl diameter Number of washes | | | |
|---|---|---|---|---|
| | Before washing | 1 Wash | 5 Washes | 10 Washes |
| PA 81/PE 19/Agent F 1% | 36.5 | 39.8 | 40.5 | 42.4 |
| PA 81/PE 19/Agent F 3% | 36.2 | 39.0 | 40.0 | 41.9 |
| PA 81/PE 19/Agent F 5% | 35.9 | 37.4 | 39.1 | 41.0 |
| PA 100% | 49.2 | 51.0 | 53.3 | 53.7 |
| PA 100/PE 0/Agent B 1% | 47.8 | 48.8 | 51.1 | 52.8 |
| PA 100/PE 0/Agent B 3% | 46.6 | 48.0 | 49.3 | 52.6 |
| PA 100/PE 0/Agent B 5% | 45.6 | 46.7 | 48.1 | 51.5 |

DESCRIPTION OF SYMBOLS

1: hopper
2: cylinder
3: screw
4: gear pump
5: spinneret
6: discharged resin
7: cooling water tank
8: guide roll
9: winding machine
25: resin discharge opening
26: resin after being discharged
27: temperature sensor

The invention claimed is:

1. A fiber for artificial hair comprising a thermoplastic polyamide and a polymeric antistatic agent having compatibility with the thermoplastic polyamide, wherein the polymeric antistatic agent has a melting point equal to or lower than the melting point of the thermoplastic polyamide and the polymeric antistatic agent has a melting point of 160 to 250° C.

2. The fiber for artificial hair according to claim 1, wherein the polymeric antistatic agent has a melt flow rate at 215° C. of 10 to 40 g/10 min.

3. The fiber for artificial hair according to claim 1, wherein the polymeric antistatic agent has a surface specific resistance value of $10^6$ to $10^{10}\Omega/\square$.

4. The fiber for artificial hair according to claim 1, wherein the polymeric antistatic agent comprises a polyetheresteramide block copolymer.

5. The fiber for artificial hair according to claim 4, wherein the polyetheresteramide block copolymer is a condensation product of polyamide having carboxyl groups at both ends and an aromatic ring-containing polyether diol.

6. The fiber for artificial hair according to claim 1, wherein the polymeric antistatic agent is contained in an amount of 0.5 to 10% by weight.

7. A fiber for artificial hair comprising a thermoplastic polyamide, a thermoplastic polyester which is incompatible with and has a higher melting point than the thermoplastic polyamide and a polymeric antistatic agent having compatibility with the thermoplastic polyamide, wherein the polymeric antistatic agent has a melting point equal to or lower than the melting point of the thermoplastic polyamide and the polymeric antistatic agent has a melting point of 160 to 250° C.

8. The fiber for artificial hair according to claim 7, having a weight ratio of the thermoplastic polyamide to the thermoplastic polyester of 75/25 to 85/15.

9. The fiber for artificial hair according to claim 7, having concavoconvex configuration formed on its surface, wherein convex portions in the concavoconvex configuration comprises thermoplastic polyester particles.

10. The fiber for artificial hair according to claim 7, having a matrix comprising the thermoplastic polyamide and a domain comprising the thermoplastic polyester.

11. The fiber for artificial hair according to claim 7, wherein the thermoplastic polyamide is at least one thermoplastic resin selected from the group consisting of a linear saturated aliphatic polyamide, an alternating copolymer of hexamethylenediamine and terephthalic acid, and an alternating copolymer of meta-xylenediamine and adipic acid.

12. The fiber for artificial hair according to claim 7, wherein the thermoplastic polyester is at least one thermoplastic resin selected from the group consisting of polyethylene terephthalate and polybutylene terephthalate.

13. A wig having a wig base and fibers for artificial hair according to claim 7 implanted in the wig base.

14. The fiber for artificial hair according to claim 7, wherein the polymeric antistatic agent has a melt flow rate at 215° C. of 10 to 40 g/10 min.

15. The fiber for artificial hair according to claim 7, wherein the polymeric antistatic agent has a surface specific resistance value of $10^6$ to $10^{10}\Omega/\square$.

16. The fiber for artificial hair according to claim 7, wherein the polymeric antistatic agent comprises a polyetheresteramide block copolymer.

17. The fiber for artificial hair according to claim 16, wherein the polyetheresteramide block copolymer is a condensation product of polyamide having carboxyl groups at both ends and an aromatic ring-containing polyether diol.

18. The fiber for artificial hair according to claim 7, wherein the polymeric antistatic agent is contained in an amount of 0.5 to 10% by weight.

* * * * *